US006606803B1

(12) United States Patent
Ritter et al.

(10) Patent No.: US 6,606,803 B1
(45) Date of Patent: Aug. 19, 2003

(54) FOOTWEAR SOLE AND ARCH STRAPPING SYSTEM

(75) Inventors: Brett D. Ritter, Santa Barbara, CA (US); Damon R. Butler, Portland, OR (US); Barry Joseph McGeough, Santa Barbara, CA (US); Edward J. Norton, Boxford, MA (US); Zenon O. Smotrycz, Reading, MA (US)

(73) Assignee: Deckers Outdoor Corporation, Goleta, CA (US)

( * ) Notice: Subject to any disclaimer, the term of this patent is extended or adjusted under 35 U.S.C. 154(b) by 0 days.

(21) Appl. No.: 09/786,239

(22) PCT Filed: Sep. 3, 1999

(86) PCT No.: PCT/US99/20297

§ 371 (c)(1),
(2), (4) Date: May 17, 2001

(87) PCT Pub. No.: WO00/13537

PCT Pub. Date: Mar. 16, 2000

(51) Int. Cl.[7] ..... A43B 3/12; A43B 3/18

(52) U.S. Cl. ..... 36/11.5; 36/7.5; 36/58.5; D2/916; D2/929; D2/943

(58) Field of Search ..... 36/11.5, 100, 101, 36/7.5, 15, 58.5, 76 R, 76 C, 76 HH, 72 A, 73, 75 R; D2/916, 929, 933, 939, 943

(56) References Cited

U.S. PATENT DOCUMENTS

| | | | | | |
|---|---|---|---|---|---|
| 1,283,335 | A | | 10/1918 | Shillcock | |
| 1,884,301 | A | | 10/1932 | Shaft | |
| 2,126,094 | A | | 8/1938 | Daniels | |
| 2,259,273 | A | * | 10/1941 | Smith | 36/11.5 |
| 2,451,372 | A | * | 10/1948 | Ballenger | 36/11.5 |
| 2,526,940 | A | * | 10/1950 | Fello | 36/11.5 |
| 2,590,648 | A | * | 3/1952 | Pitz | 36/11.5 |
| 2,642,677 | A | * | 6/1953 | Yates | 36/11.5 |
| 2,680,309 | A | * | 6/1954 | Peterson | 36/101 |
| 2,788,591 | A | | 4/1957 | Gibson | |
| 2,862,311 | A | | 12/1958 | Ellis | |
| 3,327,410 | A | | 6/1967 | Park | |
| 4,200,997 | A | | 5/1980 | Scheinhaus et al. | |
| 4,300,294 | A | | 11/1981 | Riecken | |
| 4,314,412 | A | | 2/1982 | Anderson et al. | |
| 4,333,247 | A | | 6/1982 | Marinelli | |
| 4,411,077 | A | | 10/1983 | Slavitt | |
| 4,446,633 | A | | 5/1984 | Scheinhaus et al. | |
| 4,753,022 | A | | 6/1988 | Gasbarro | |
| 4,811,498 | A | | 3/1989 | Barret | |
| 4,813,162 | A | | 3/1989 | Harris | |
| 4,817,302 | A | | 4/1989 | Saltsman | |
| 4,843,736 | A | * | 7/1989 | Courian | 36/11.5 |
| 4,869,000 | A | | 9/1989 | York, Jr. | |
| 4,967,750 | A | | 11/1990 | Cherniak | |
| 5,056,241 | A | * | 10/1991 | Young | 36/11.5 |
| 5,379,529 | A | | 1/1995 | Smith et al. | |
| 5,430,959 | A | | 7/1995 | Mitsui | |
| 5,438,767 | A | | 8/1995 | Stein | |
| 5,819,439 | A | | 10/1998 | Sanchez | |
| 5,960,565 | A | | 10/1999 | Lochbaum | |

* cited by examiner

*Primary Examiner*—Anthony D. Stashick
(74) *Attorney, Agent, or Firm*—Greer, Burns & Crain, Ltd

(57) ABSTRACT

A strapping system for footwear comprises a strap (1) that has a first end (3) connected to a first side of a heel portion (12) of footwear, passes over the instep of a foot, through a channel (31) extending through the midfoot of the footwear sole and back over the foot instep to thereby forming an X shape over the wearer's foot. The strap (1) has a second end (11) which may be adjustably connected to the second side of a heel portion (12) of a sole. The channel (31) is resilient and rigid so as to allow the strap freedom of movement during use: thereby achieving a dynamic and self adjusting strap fit. A footwear sole comprises relatively soft forefoot and heel portions with a more rigid shank portion therebetween to provide the sole with stiffness and torsional rigidity.

6 Claims, 5 Drawing Sheets

FOOTWEAR SOLE AND ARCH STRAPPING SYSTEM

CROSS-REFERENCE

This application is a Section 371 application of PCT/US99/20297 filed Sep. 3, 1999, which claims priority from U.S. Ser. No. 09/148,306 filed Sep. 4, 1998, now U.S. Pat. No. 6,061,929 and U.S. Ser. No. 09/196,977 filed Nov. 20, 1998, now abandoned.

BACKGROUND

1. Field of the Invention

The present invention relates to footwear. In particular, the present invention is related to strapping systems for securely affixing footwear to a user's foot, and to shanks for providing rigidity and support to shoe soles.

2. Background of the Invention

There is a wide variety of prior art showing strapping configurations for footwear. Generally, the purpose of such strapping may be summarized as securing the footwear to a user's foot and is often used in connection with sandals.

Examples of prior art showing sandal or footwear strapping arrangements include U.S. Pat. Nos. 4,200,997 and 4,446,633 to Scheinhaus, U.S. Pat. No. 4,679,334 to McBride, U.S. Pat. No. 3,327,410 to Park, U.S. Pat. No. 4,793,075 to Thatcher, U.S. Pat. No. 4,817,302 to Saltsman, U.S. Pat. No. 4,300,294 Riecken, U.S. Pat. No. 2,788,591 to Gibson, U.S. Pat. No. 2,126,094 to Daniels, and U.S. Pat. No. 2,862,311 to Ellis. Each of these patents disclose strapping configurations which generally engage the ankle, heel, instep, toes, arch, or some combination thereof to secure the footwear to the user's foot. None of these prior art disclosures, however, nor any other existing strapping configurations have been entirely satisfactory in securing footwear to the foot while maintaining a comfortable, durable, and convenient configuration. This problem is particularly acute for sandals used in sports or other vigorous activities. As sandals have become more frequently worn in these active endeavors, demands on strapping configurations have grown. No known existing sandal strapping configuration allows for the natural adjustments of the foot and ankle during activity; such adjustments would enhance user comfort and ease of use.

One particular problem relates to ankle or instep straps. As the angle between the foot and the ankle changes during normal walking or running, the foot's main tendon that travels down the front of the leg and across the instep of the foot is alternately tightened and loosened. This causes the overall circumference of the ankle and instep to increase and decrease. Any strapping that wraps the ankle must allow for this expansion and contraction, which necessitates such strapping to be able to compensate for the size variation. Without such compensation, the ankle strapping may overly restrict foot movement.

Prior footwear straps are typically oriented in a direction that does not correspond to the force vectors that occur during walking, running, or vigorous activity. Strapping usually is oriented at an angle of approximately 90° from the sole. This angle is appropriate to maximize strapping strength only when the strap lies flat and parallel to the sole on the foot surface. As the top of the foot slopes forward, however, a strap oriented at a 90° angle from the sole must twist to lie flat on the sloping foot surface. This causes discomfort in the user and diminishes the strength capacity of the strap.

Still other prior art footwear strapping configurations feature a continuous strap that contacts the wearer's foot in multiple locations, such as around the ankle, across the instep, and over the front of the foot. Such straps cannot remain taut during activity, due to movement of other portions of the foot. A continuous strap that covers both the instep and the forefoot, for instance, may lack the continuous, taut fit over the instep due to movement of the forefoot.

In addition to footwear strapping systems, other problems related to movement of the sole in relation to the foot also remain unresolved by the prior art. In particular, difficulties are associated with providing torsional rigidity, arch support, and overall stiffness to a sole during walking, running, or other vigorous activity. While a generally soft and cushioned sole forefoot and heel portion are desirable for wearer comfort, they may result in a sole being undesirably soft and "floppy". To prevent this condition, a relatively stiff and rigid shank may be provided to bridge the softer, less rigid forefoot and heel portions. The more rigid shank also provides torsional rigidity to the sole, preventing undesirable twisting motions during a wearer's stride.

Prior art shanks include metal plates inserted in the midfoot region between the midsole and either an outsole or an insole; a laterally narrow section of rubber or other material attached to the bottom outsole in the midfoot region (generally known as a "fiddleshank"); and other plastic components molded or glued to the sole midfoot region for support and rigidity. Such prior art shanks do not, however, adequately prevent and generally, are not well-configured to counteract the twisting type of torsional forces developed during wearing of footwear, especially those forces caused by straps that pass through the sole.

Numerous unresolved needs therefore exist relating to footwear. A long felt need exists for a footwear strapping configuration that accommodates the foot's wide range of movement during sports or other vigorous activities. In addition, a need exists for strapping that is capable of dynamically adjusting itself as required during such use. Further, unresolved needs exist for an integral, stiff and rigid shank portion to provide torsional rigidity and stiffness to an otherwise relatively soft and cushioned footwear forefoot and heel portions.

SUMMARY OF THE INVENTION

A first embodiment of the present invention comprises a unique strapping configuration for footwear that provides for dynamic fit adjustment while securely and comfortably affixing a sole to a wearer's foot. The strapping generally includes an adjustable X configuration strap which is attached in some manner to a heel portion of the footwear, crosses over the wearer's instep, and passes through a transverse channel in the midsole of the footwear under the wearer's arch. The present invention further comprises footwear incorporating the unique strapping configuration that securely fastens the footwear to the user's foot, even during sports or other vigorous activities.

The adjustable X configuration instep strap generally has a first end secured to a first side of a heel portion of the footwear, crosses forwardly and transversely over the wearer's instep, passes through a channel in the sole of the footwear at the midfoot, the longitudinal center of the sole, extends rearwardly and transversely back across the wearer's instep (thereby forming an X over the instep), and is adjustably and releasably secured to the second side of the heel portion of the footwear. The channel may be angled downwardly from rear to front in the longitudinal direction, parallel to the downward slope of the wearer's instep, so that the strap will lie flat on the wearer's instep and thereby more evenly carry forces that develop between the foot and the sole during sports or other vigorous activities.

The X configuration instep strap acts to secure the wearer's foot to the footwear sole. The strap preferably passes under the wearer's arch through the midfoot channel, and thereby works to secure the transverse midfoot portion of the sole to the bottom of the wearer's foot.

The portion of the footwear sole through which the midfoot channel passes, the midfoot shank, is preferably comprised of a relatively stiff and hard material. Incorporation of such shank material enables the channel to not significantly compress and thereby not pinch the strap passing through it during use. The strap may thus be free to move through this channel as the foot moves in different directions during use. The sole including the arch channel may be manufactured separate from the sole and may be affixed thereto by molding or with an adhesive. This allows for the shank including the midfoot channel to be constructed of a relatively hard and stiff material and to be conveniently attached to a softer, more pliable sole. Alternatively, the shank portion may also be an integral portion of the sole. The relatively stiff and resilient arch channel also functions as a standard type shank to add desirable stiffness and torsional rigidity to the sole, as will be discussed in greater detail below in relation to additional embodiments of the invention.

In addition to the X-strap of the invention, the preferred sandal embodiment further may comprise a front strap system for releasably attaching the sole to the forefoot, and a heel strap system for releasably attaching the sole to the wearer's heel. Preferably, the heel strap system may include a pair of opposing heel posts that may extend upward from the sole at the medial and lateral sides of the heel portion of the sole. Further, the heel strap system may include a T-strap having a downwardly extending portion that attaches to the center, rear of the sole, behind the wearer's Achilles tendon. The two free ends of the X-strap can be connected to the front of the lateral and medial heel posts. A side member or lateral strap may be further used that extends from the lateral heel post to the front strap to provide additional support for the foot. However, additional strap configurations now known or hereafter devised by those skilled in the art may be utilized.

As indicated above, the present invention optionally further comprises a footwear sole having relatively soft, low density forefoot and heel portions with a higher density, more rigid shank portion. The two distinct density materials may be hot compression molded together to from a structurally integral unit. The high density, more rigid shank portion of the invention may, but need not, comprise the transverse channel described above for passing a strap. In addition, the sole of the invention may be particularly well suited for, but is not limited to, use in sandals.

In accordance with various aspects of the present invention, the sole may comprise a molded unit of two or more different densities of thermoplastic or thermosetting polymer compounds. One compound may be of suitably low density and hardness to provide flexibility and cushion. Near the midfoot region of the sole, underlying the user's arch, is a shank portion comprising a denser, harder, stiffer compound. The presence of the higher density, stiffer shank tends to insure that the arch of the foot will have improved support. In addition, the relatively stiff shank is desirable to lend structure and support to the sole at the midfoot region where the outsole does not touch the ground, to provide a desirable overall stiffness to the sole during walking, and to provide torsional rigidity. The structural effect of the shank may be easily controlled by varying the hardness of the shank as desired.

Before explaining the several embodiments of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

The advantages of the present invention will become more fully apparent from the following detailed description when read in conjunction with the accompanying drawings.

BRIEF DESCRIPTION OF THE DRAWING FIGURES

DETAILED DESCRIPTION OF PREFERRED EMBODIMENTS OF THE INVENTION

Figure 1:
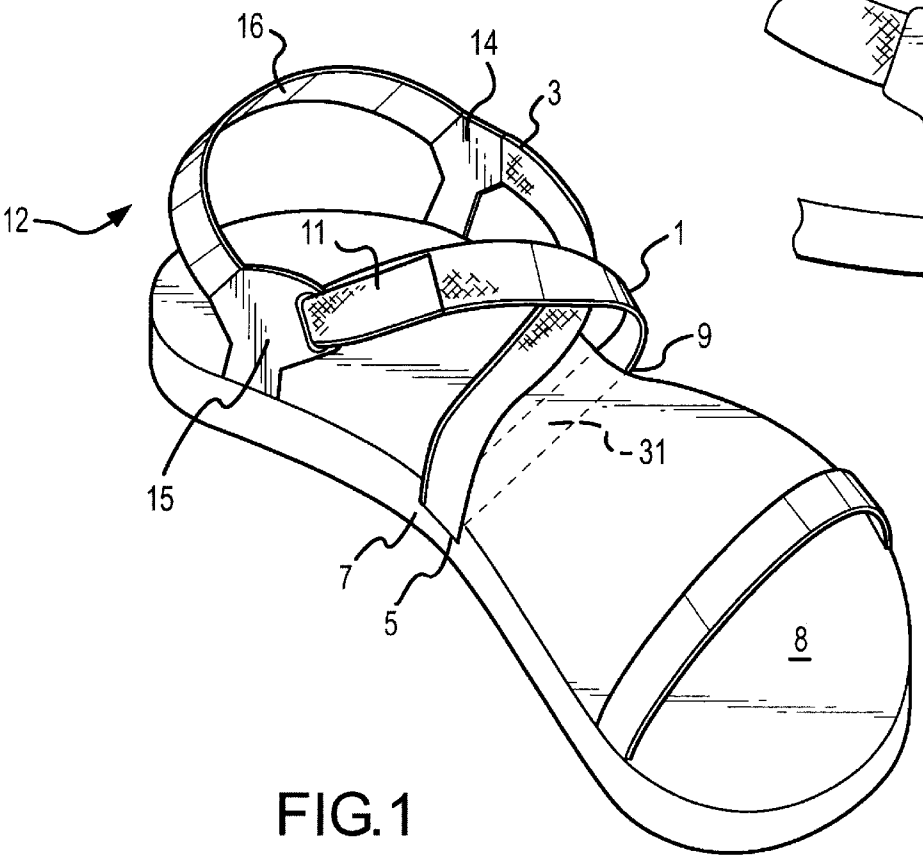
FIG. 1 is a perspective view of one embodiment of a strapping system of the present invention.

Turning now to the drawing figures, FIG. 1 is a perspective view of footwear showing one embodiment of the strapping system of the present invention. The footwear may be of any type, including sandals. The footwear, as is conventional, includes a forefoot and heel portions, with a midfoot portion therebetween. In accordance with certain aspects of the present invention, a channel 31 is provided through the midfoot portion of a sole of the footwear, underlying the user's arch, as more fully explained below.

Preferably, strap 1 is operatively attached at a first end 3 to one side, e.g. the lateral side, of the heel portion of the footwear. Strap 1 preferably extends transversely across and forwardly across and over the instep of a wearer's foot. In accordance with certain aspects of the present invention, a strap passes through midfoot channel 31, entering at a medial side 5 and emerging at a lateral side 9. Strap 1 then preferably extends in a rearward, transverse direction back across the foot instep. Strap 1 is preferably adjustably attached at a second end 11 to the medial side of a heel portion of the footwear.

While the heel strap system (heel portion) 12 is generally shown in FIG. 1 as comprising two upstanding posts 14, 15 and a heel strap 16 interconnected therebetween, it should be appreciated, as previously briefly noted, that other strap configurations or heel portions may be used. For example, the heel strap system may comprise a unitary structure formed of webbing or other material, or may comprise a plurality of interconnected straps. These and other modifications are within the scope of the present invention.

Moreover, it should be appreciated that ends 3 and 11 may be attached to heel portion 12 at any desirable location, for example at any point along the path traversed by strap 16.

Figure 2:
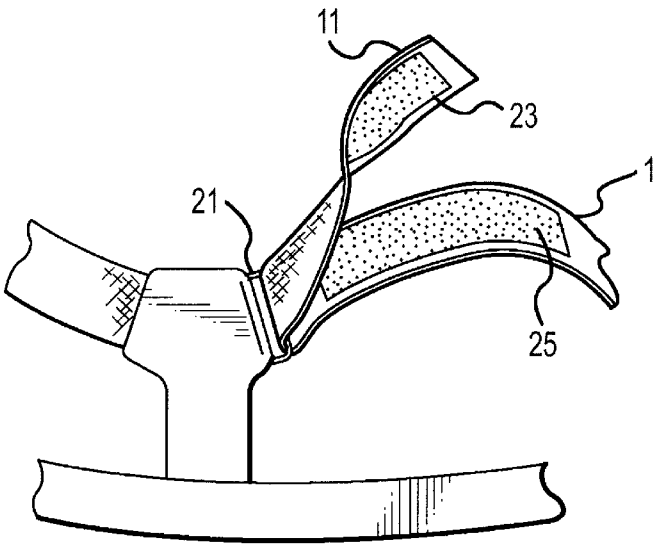
FIG. 2 is a detail of one embodiment of a fastener for use in connection with of the strapping system of the present invention.

One attachment device useful for attaching at least a portion of strap 1 to heel portion 12 is illustrated in FIG. 2, comprising mating hook and loop fasteners. In accordance with this embodiment, strap 1 passes through a pivot loop 21 attached to the heel post 15 of the footwear. A section of mating hooks 23 are preferably located on the bottom of strap 1 near strap second end 11. A corresponding section of mating loops 25 are located on the top side of strap 1. Strap 1 may thereby be adjustably and removably attached to itself by pulling it through pivot loop 21 to a desired tightness and releasably fixing section of hooks 23 onto section of loops 25. Other attaching devices may comprise mating female-male connectors, buckles, friction buckles, snaps, buttons, shoe laces, or other fasteners now known or hereafter devised in the art. Moreover, strap 1 may be adjustably attached at end 3 to heel portion 12, or alternatively not be adjustably attached to either end 11 or 3.

Preferably, strap 1, as previously noted, passes through channel 31. In accordance with various alternative embodiments, however, strap 1 may be attached to or within the sole 8.

Figure 4:
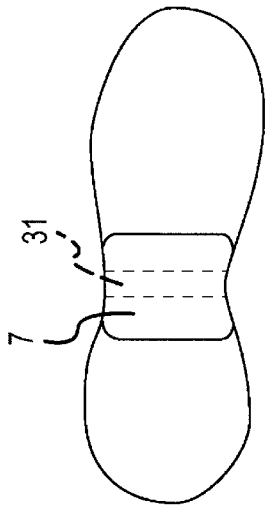
FIG. 4 is a bottom plan view of the midfoot channel of the strapping system of the present invention.

With reference now to FIG. 4, channel 31 preferably extends across the width of the midfoot region of the sole and is substantially perpendicular to a longitudinal axis of the sole. Angular orientations, for example, from front to back or vice versa, may also be utilized.

In accordance with various aspects of the present invention sole midfoot region 7 may include a shank 7. Shank 7 may comprise any resilient, stiff material to help prevent channel 31 from collapsing and pinch strap 1 when force is applied downward on the shank 7 during use. The stiffness and resiliency of shank 7 also tends to impart advantageous strength and torsional rigidity to the sole. Shank 7 may be manufactured separate from the softer and more pliable sole and attached thereto with an adhesive or the like. Alternative methods of manufacture may be used, such as molding the shank integrally with the other portions of the sole as will be described below. In cases where shank 7 comprises a separate component, channel 31 may be molded directly into shank 7, or a passageway, grove or other device may be formed on shank 7 to permit passage of strap 1 therewithin or therewithon.

In accordance with a preferred aspect of the present invention, strap 1 is free to move through channel 31, thereby tending to enable a dynamic, self adjusting fit. For example, as the foot may shift and move about during use, midfoot channel 31 allows strap 1 freedom to respond. This allows for strap 1 to maintain its fit across the foot instep and for maintenance of a correspondingly firm, responsive, and comfortable fit even during vigorous activity. However, movement of strap 1 in channel 31 is not required.

Figure 3:
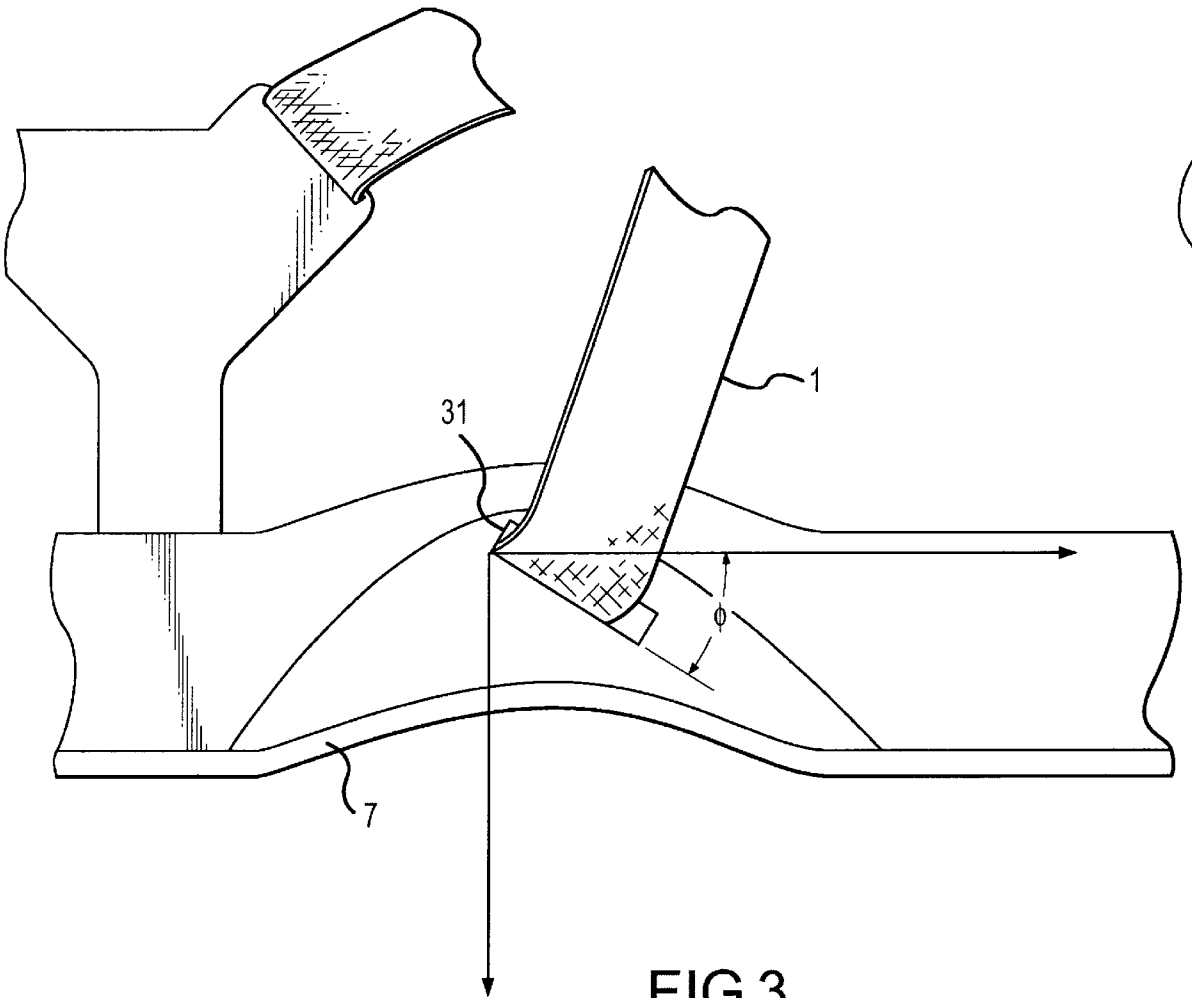
FIG. 3 is a detailed medial side view of the midfoot channel useful in connection with the strapping system of the present invention.

With reference now to FIG. 3 an expanded medial side view of channel 31 in the sole midfoot region 7 shows strap 1 passing there through. Midfoot channel 31 may be generally configured in any desirable orientation. Preferably, and with continued reference to FIG. 3, channel 31 is angled forward and downward at an angle of Ø. Angle Ø is preferably between about 2° and about 15°, and more preferably between about 3° and about 6° measured from a horizontal plane as shown in FIG. 3. In accordance with this aspect, as the respective ends of the X-strap 1 extend upward and over the wearer's instep, the angle Ø will tend to be maintained, thus causing the surface of strap 1 to lie approximately flat on the sloping instep of the wearer's foot. Angling the channel in a downward and forward longitudinal direction tends to desirably direct the respective ends of strap 1 in a forward and upward direction closely matching a typical forward and upward direction that the sole is pulled by the foot during walking or running. In this manner the angling of channel 31 may maximize the ability of strap 1 to absorb forces developed during use, and provides for user comfort as strap 1 will tend to lie flat on a wearer's instep. However, other midfoot channel configurations with channel 31 extending horizontally, upwardly or other configurations may be employed.

Strap 1 may be fabricated from any suitable flexible material having sufficient tensile strength, such as a woven fabric, leather, suede, and any known material in the art. A preferred strap comprises woven nylon as is well known in the art. Fabric weaves may optionally comprise reflective material, thereby providing 360° reflectivity for enhanced user safety.

Figure 5:
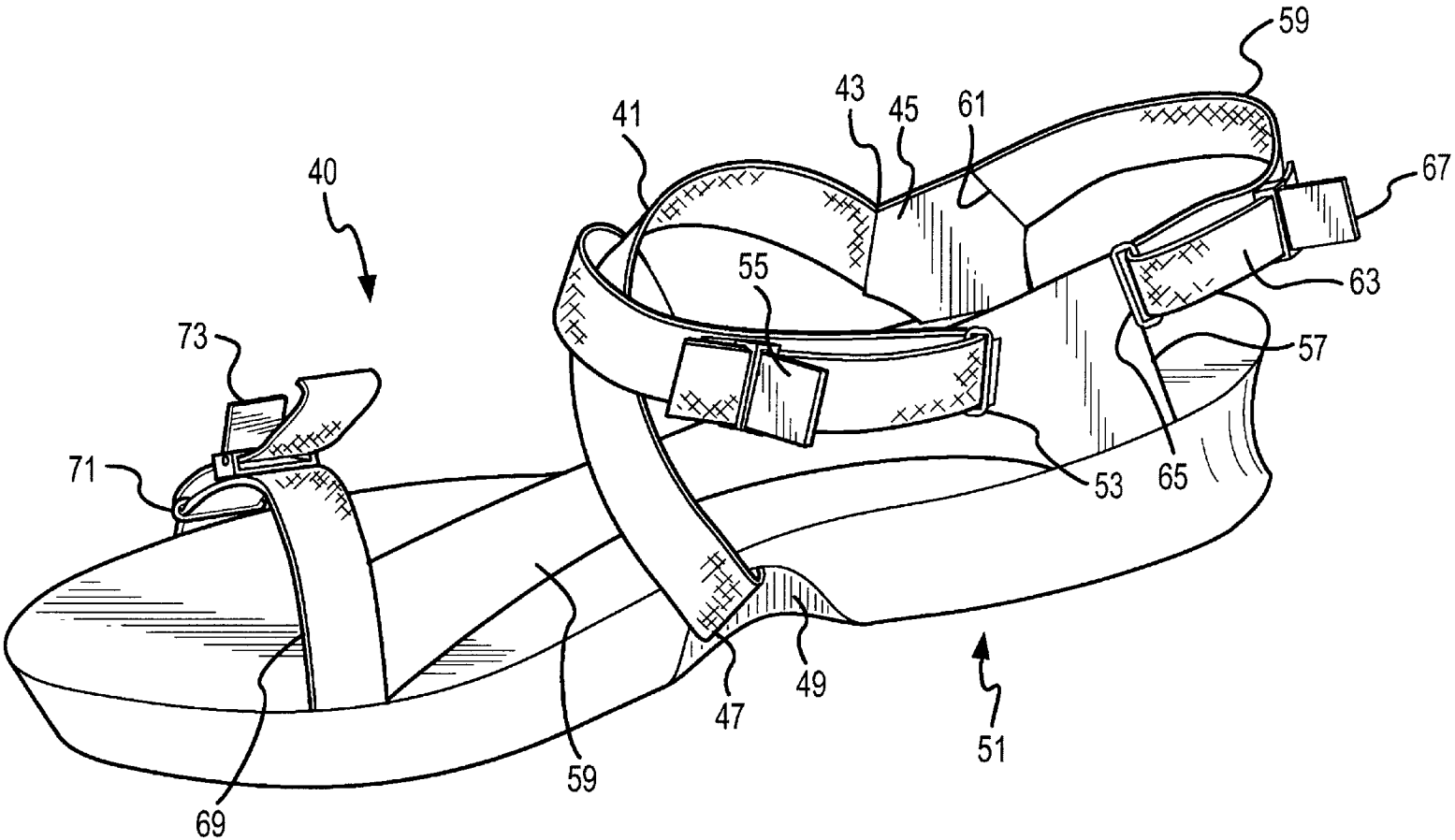
FIG. 5 is a perspective view of one embodiment of a footwear article of the present invention incorporating the strapping system of the present invention.

While the strap assembly set forth in FIG. 1 and variously referred to herein as a "strap assembly" may be used on a variety of footwear products, a preferred embodiment in accordance with the present invention comprises a sandal 40, such as is shown in FIG. 5. Sandal 40 preferably includes a sole 51 and a variety of straps including a version of the strap assembly hereof connected thereto. Preferably, a strap 41 has a first end 43 attached to a heel post 45. Strap 41 passes over a foot instep and into a channel 47. Channel 47 preferably extends transversely through sole 51. After exiting channel 47, strap 41 passes back over the foot instep, through a midfoot loop 53. A fastener 55 for adjustable fastening of strap 41 to heel post 57 cooperates to secure strap 41 to loop 53. Strap 41 thereby forms an X-shape over the wearer's instep. Fastener 55 may comprise a buckle with lever as illustrated, or other means as are known in the art, including, for example, hook and loop fasteners, male-female connectors, buckles, buttons, snaps, shoe laces, and the like.

Sole midfoot region 49 may be fabricated from a resilient and relatively stiff material to provide desirable torsional rigidity to the softer and more pliable sole 51. In addition, the stiff and relatively rigid construction of midfoot region, or shank 49, provides support to the arch region of a wearer's foot. Advantages related to torsional rigidity and arch region support will be discussed in greater detail below in association with additional embodiments of the invention.

Because preferred sole midfoot region 49 may be comprised of a resilient plastic material while sole 51 may be comprised of a softer, more pliable material, sole midfoot region 49 is preferably manufactured separate from sole 51 and then affixed thereto using adhesives or the like. Midfoot region 49 need not necessarily be prepared separately from sole 51 and attached thereto; it may also be integral with sole 51. Sole 51 is constructed as generally known in the art, and may, for example, be comprised of a relatively tough and wear resistant outsole, and a softer and more cushioned midsole. A soft insole or footbed for contact with the wearer's foot may be adhered to the upper surface of the sole. As used herein, the term "sole" refers to the structural sole of the footwear, and includes a unitary sole, an outsole and/or midsole, but does not encompass an insole. Sole 51 is preferably molded of ethylene vinyl acetate.

A heel strap 59, for securing a wearer's heel to the footwear, is preferably attached at a first end 61 to a medial heel post 45, and at a second end to lateral heel post 57. Heel strap 59 second end 63 preferably is adjustable, and thus may extend through heel loop 65, and through a heel fastener 67. Fastener 67 may comprise any of several fasteners that are well known in the art, including, for example, a lever operated buckle as illustrated, mating hooks and loops, mating male/female buckles, buttons, laces, snaps, or the like. Heel strap 59 desirably may be provided with a downwardly extending T-strap member (not shown) that attaches to the center, rear of the sole. If a T-strap is utilized, heel strap fasteners may be provided at one or both of the lateral and medial heel posts so that the wearer may adjust the T-strap as desired. As previously noted, other heel strap configurations may also be used.

Sandal 40 may also include a lateral side member 59 and forefoot strap 69. Lateral side member 59, when employed, preferably extends between heel post 57 and forefoot strap 69. Forefoot strap 69 adjustably secures a wearer's forefoot to sole 51. For example, forefoot strap 69 may be adjustably tightened through front loop 71, and fastened back onto itself through fastener 73. Fastener 73 may comprise any of the several fasteners as known in the art, including, for example, mating hook and loop fasteners, buttons, laces, buckles, and the like.

Although various of the embodiments of the invention have been illustrated and described herein as generally in use with sandals, it will be understood by those knowledgeable in the art that the X-strap of the invention may likewise prove advantageous for use with other types of footwear. In particular, the X-strap of the invention will be useful in any application where a snug, responsive, and dynamic fit between foot and footwear is desired.

As discussed above, the present invention may optionally further comprise an improved shank configuration for providing a footwear sole with torsional rigidity, arch support, and stiffness. These advantages are best described in relation to the invention embodiments illustrated in FIGS. 6–9.

Figure 6:
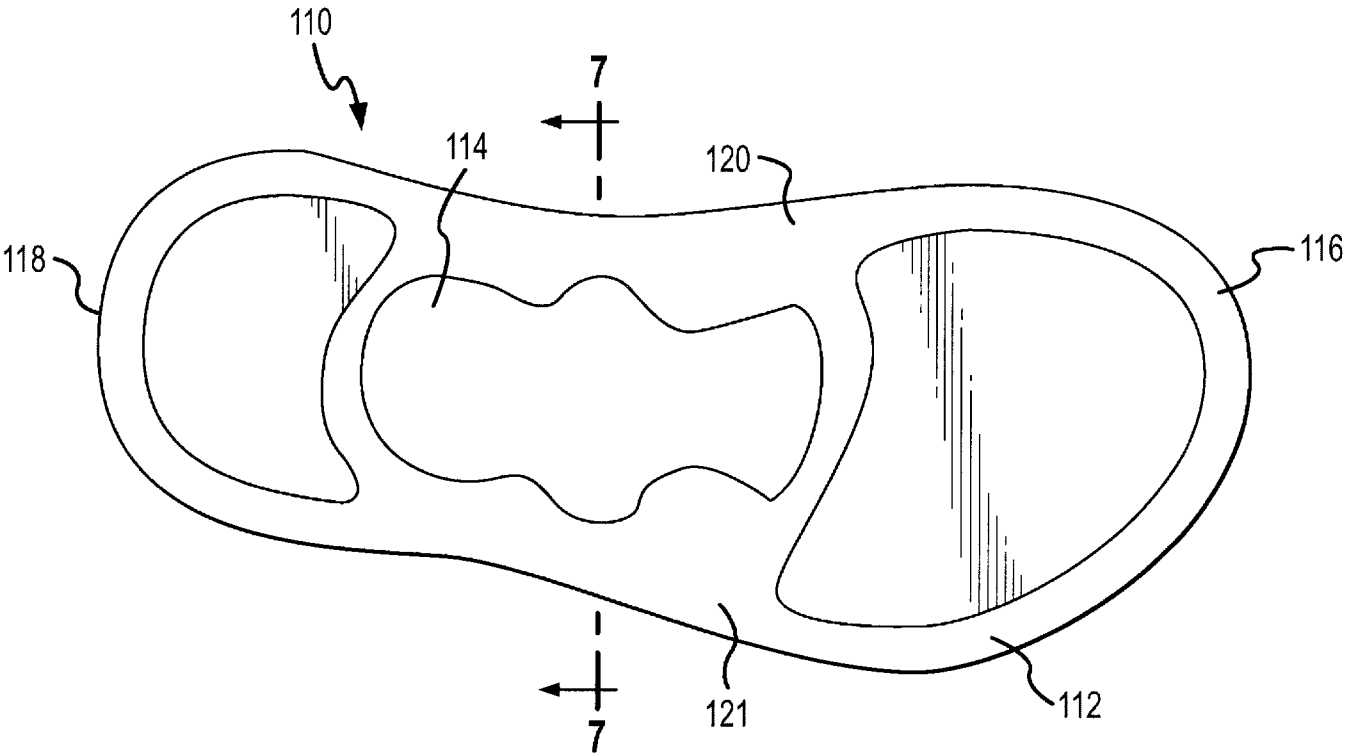
FIG. 6 is a plan view of one embodiment of a sole of the present invention having an integral shank.

FIG. 6 is a plan view of an embodiment of a sole 110 comprising a sole piece 112 and an integral shank 114 fused therein. Sole piece 112 is generally in the shape of a foot and includes a forefoot portion 116, a heel portion 118, a medial side 120 and a lateral side 121. Sole piece 112 may be comprised of a wide variety of thermoplastic and thermosetting polymer compounds. Ethylene vinyl acetate ("EVA") foam is preferred, but other compounds may be used. The density and hardness of sole piece 112 may be set as desired, with a relatively soft, cushioned consistency desirable for foot comfort. Hardness ranges for sole piece 112 will range between about 30 and about 60 Shore C hardness, with a preferred hardness of about 55+/−2 Shore C. Shank 114 resides in the midfoot region of sole 110, underlying the user's arch and bridging the heel and forefoot region.

Figure 7:
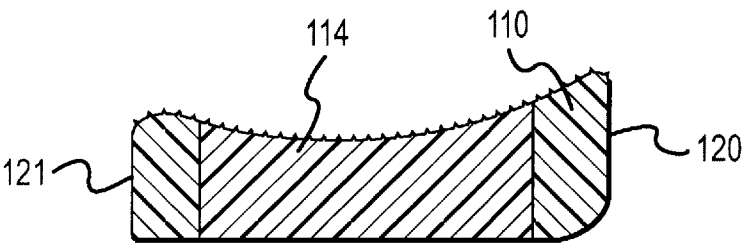
FIG. 7 is a cross section taken along the line 7—7 of FIG. 6.

Shank 114 preferably extends all the way through the sole 110 in a vertical direction, as best seen in FIG. 7. In addition, shank 114 is not located only in either the medial or lateral portion of sole 110, but preferably extends into both portions for optimum torsional rigidity. An embodiment of the shank of the invention may extend substantially across the transverse width of the footwear sole, as generally described hereinabove with reference to previous footwear embodiments of the invention. The specific configuration of the shank is not critical, but preferably Shank 114 is sized to bridge between the heel and forefoot regions of the sole. Shank 114 may also be comprised of a suitable thermoplastic or thermosetting polymer compound, with EVA foam preferred. Shank 114 may optionally comprise a channel (like channel 31 shown in FIG. 1) for passing a strap as described above with reference to previously illustrated embodiments of the invention. The composition of shank 114 is denser, and hence stiffer and harder, than sole piece 112. In accordance with certain embodiments of the present invention, shank 114 preferably has a hardness in the range of between about 55 and about 85 Shore C hardness, with a preferred hardness of about 80+/−2 Shore C. Preferably a differential of about 20 to about 30 Shore C hardness exists between sole piece 112 and shank 114.

A preferred method of making the integral sole piece 112 and shank 114 of the invention comprises the steps of cutting out a portion of sole piece 112 corresponding to the shape of shank 114, cutting out a shank piece 114 from suitable hardness material, and hot compression molding shank 114 into sole piece 112. Chemical cross-linking bonds are thereby formed between shank 114 and sole piece 112, integrally fusing shank 114 with sole piece 112. Other methods of attachment comprise use of adhesives or the like.

Figure 8:
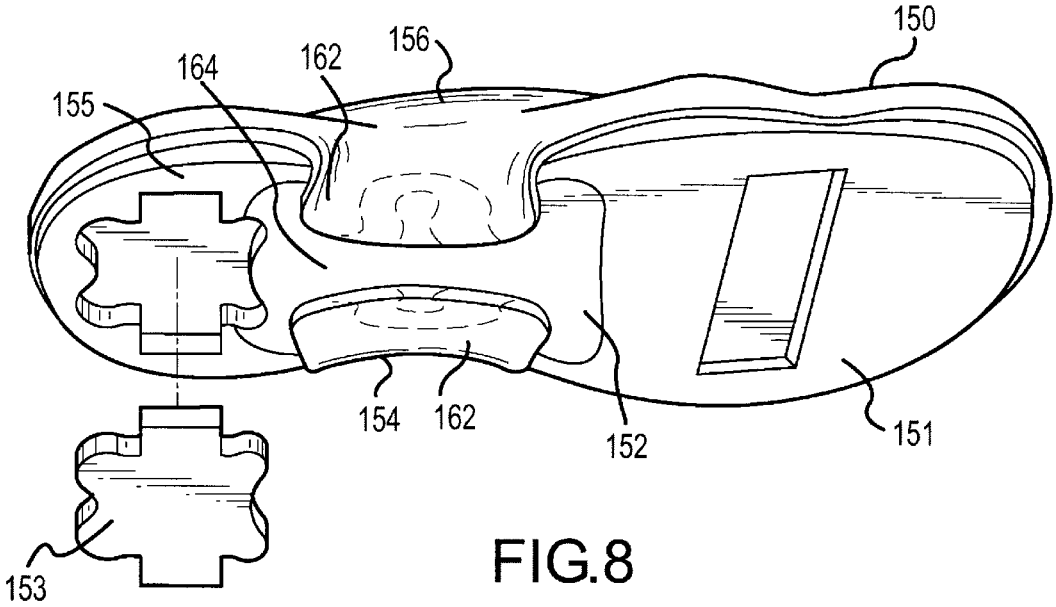
FIG. 8 shows a bottom and medial side perspective view of a second embodiment of a midsole of the present invention having an integral shank; and, FIG. 9 is an exploded top and medial side perspective view of the second embodiment of a midsole of the present invention.
Figure 9:
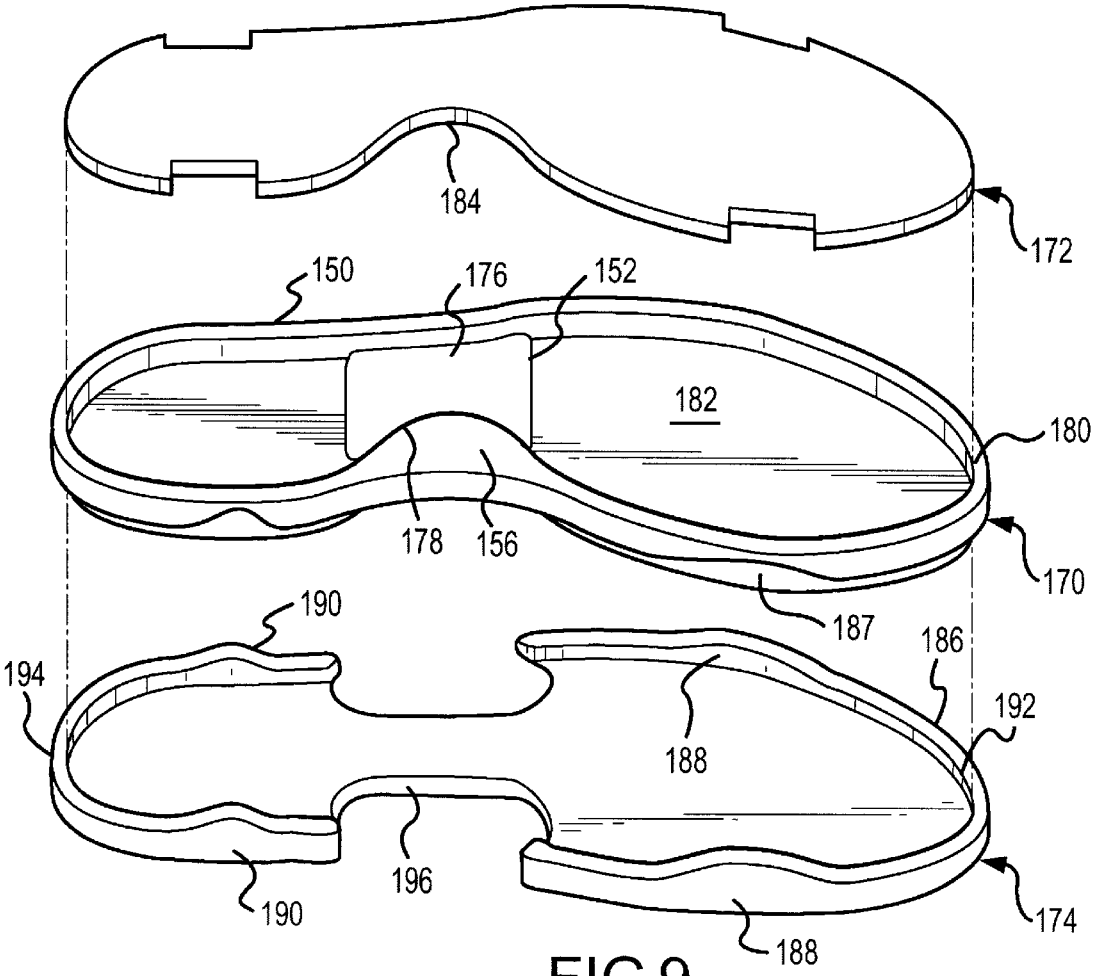

FIGS. 8 and 9 illustrate a sole in accordance with an additional embodiment of the invention. FIG. 8 is a bottom and medial side view of a midsole of the invention, while FIG. 9 is an exploded top and medial side view of the entire sole of this embodiment. Midsole piece 150 preferably has a bottom surface 151 and an integrally molded midfoot shank 152. Shank 152 is preferably comprised of EVA foam with a hardness of between about 55 and about 85 Shore C, while midsole piece 150 is preferably comprised of EVA foam with a hardness of between about 30 and about 60 Shore C, approximately 20–30 Shore C less than shank 152.

Midsole piece 150 is preferably configured to include an upwardly arched midfoot portion 154 that extends laterally across the sole. The medial side of midfoot 154 preferably has a thicker, raised portion 156 adapted to underlie and support the user's medial arch. In this embodiment, the bottom surface of shank 152 is preferably molded to provide two opposing lobes 162 protruding downwardly at the lateral and medial midfoot, and thereby forming a shallow groove 164 between them. The foregoing features, including the arch 154, raised portion 156, lobes 162 and groove 164, are preferably formed when the midsole sole piece 150 and shank 152 are hot compression molded together to form integral midsole 170.

A shock pad 153 is optionally provided, preferably at the center of the heel region 155. Pad 153 may be separately formed and may be inserted into a molded cavity in midsole 150 to absorb energy from a heel strike and release the energy when the user moves forward in a resilient, spring-like manner. Shock pad 153 operates in combination with shank 152 to reflect and rebound energy in a forward direction. This combination has been found to provide benefits over either shock pads or integral shanks employed individually.

Turning now to FIG. 9, midsole 170 is preferably sandwiched between a top sole 172 and an outsole 174. A top surface 176 of shank 152 preferably having a raised arcuate portion 178 protrudes upwardly on the medial side of the midfoot, underlying the user's medial arch. Integral midsole 170 has a raised perimeter edge 180 and a broad recessed area 182 between edge 180 and the raised arcuate portion 178. Top sole 172 is affixed to the top surface of integral sole 170 as depicted in FIG. 7. An exemplary embodiment of top sole 172 has a shape and thickness that correspond to the recess 182 in the midsole 170, so that a substantially flush surface results upon attachment of the top sole to the midsole. Top sole 172 is preferably comprised of EVA foam with a hardness of about 20 to about 40 Shore C durometer.

Top sole 172 may have an arcuate indentation 184 at the medial midfoot to match raised portion 178 of shank 152 thereby enabling exposure of portion 178 when top sole 172 is in place. Alternatively, top sole 172 may completely cover shank 152 including raised portion 178. In either case, however, preferably a substantially flush outer surface is obtained. For example, outsole 174 may include a raised ridge 186 about its outer perimeter that will wrap around outer, lower edges 187 of the midsole. A preferred outsole raised edge 186 has opposing front side portions 188, opposing rear side portions 190, front end 192, and back end 194 that are raised higher than the remainder of raised edge 186. These regions correspond to areas of increased wear, thereby making durable outsole 174 desirable.

Outsole 174 preferably includes a bridge portion 196 which rests in the shank groove 164 of the midsole. Placement of bridge portion 196 in groove 164 helps to stabilize outsole 174 from lateral movement relative to the midsole. Outsole 174 may be comprised of any resilient, rubber like material, or polyurethane, and is preferably attached to the bottom of integral sole 170.

The advantages of the disclosed invention are thus attained in an economical, practical, and facile manner. While preferred embodiments and example configurations have been shown and described, it is to be understood that various further modifications and additional configurations will be apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. An X-strap assembly for securing an article of footwear to the instep of a foot, said footwear having a sole and channel through said sole, said X-strap assembly comprising:

a) a strap attached at its respective ends to medial and lateral heel sides of said footwear, said strap having a first portion extending in a forward direction transversely across the instep from a first side of said footwear to a second side, a second portion extending through said channel, and a third portion extending in a rearward direction transversely across the instep from said first side to said second side of said footwear, said first and said third portions forming an X-configuration over said instep; wherein said channel is located at the mid-foot portion of the sole, and wherein said channel passes completely across the sole; and b) a fastener attached to said strap.

2. An article of footwear, comprising:

a) a sole, the sole having a midfoot portion and a heel portion;

b) a channel extending transversely across the midfoot portion of said sole;

c) an instep strap connected to said heel portion of said sole, said instep strap having a first portion extending in a forward direction transversely across a wearer's instep from one side of said sole to the other, a second portion extending through said channel and slidable within said channel, and a third portion extending in a rearward direction transversely across the wearer's instep from said one side of said sole to said other side of said sole, the first and third potions of said instep strap forming an X configuration over the wearer's instep, and the second portion being between the first and third portions of said instep strap; and d) an adjustable fastener attached to said instep strap for adjusting said instep strap.

3. An article of footwear as in claim 2, wherein said midfoot portion of said sole (51) includes a shank (114), said shank at least partly underlying said sole (51), said shank being stiffer than said sole (51), said channel (47) extending through said shank (114).

4. An article of footwear, as in claim 3, wherein said channel (47) is angled downwardly from rear to front in a longitudinal direction.

5. An article of footwear as in claim 4 further comprising a heel portion strap assembly (59), a forefoot strap assembly (69) and a lateral strap (59) extending therebetween.

6. A footwear product to be worn by a user on the user's foot, comprising:

a) a sole, the sole having a midfoot portion;

b) a transverse passageway extending through said midfoot portion of said sole;

c) a strap system configured to secure the footwear product to the user's foot including:

a heel portion, an X-strap assembly coupled to said heel portion, wherein said X-strap assembly includes a continuous strap having a first portion extending transversely across the user's instep from said heel portion on a first side of the footwear to a second side, a second portion extending through said transverse passageway from said second side to said first side, and a third portion extending transversely across the user's instep from said first side to a heel portion on said second side of said footwear, said first and said third portions of said X-strap assembly forming an X-configuration over the user's instep, and an adjustable fastener for adjusting the length of said X-strap assembly.

* * * * *

US006606803C1

(12) EX PARTE REEXAMINATION CERTIFICATE (6935th)

United States Patent

Ritter et al.

(10) Number: US 6,606,803 C1

(45) Certificate Issued: Jul. 14, 2009

(54) FOOTWEAR SOLE AND ARCH STRAPPING SYSTEM

(75) Inventors: Brett D. Ritter, Santa Barbara, CA (US); Damon R. Butler, Portland, OR (US); Barry Joseph McGeough, Santa Barbara, CA (US); Edward J. Norton, Boxford, MA (US); Zenon O. Smotrycz, Reading, MA (US)

(73) Assignee: The Peninsula Fund III Limited Partnership, Detroit, MI (US)

Reexamination Request:
No. 90/008,837, Sep. 7, 2007

Reexamination Certificate for:

| | |
|---|---|
| Patent No.: | **6,606,803** |
| Issued: | **Aug. 19, 2003** |
| Appl. No.: | **09/786,239** |
| Filed: | **May 17, 2001** |

(22) PCT Filed: Sep. 3, 1999

(86) PCT No.: PCT/US99/20297

§ 371 (c)(1), (2), (4) Date: May 17, 2001

(87) PCT Pub. No.: WO00/13537

PCT Pub. Date: Mar. 16, 2000

(51) Int. Cl.

| | |
|---|---|
| ***A43B 3/12*** | (2006.01) |
| ***A43B 3/18*** | (2006.01) |
| ***A43C 11/14*** | (2006.01) |
| ***A43C 11/00*** | (2006.01) |

(52) U.S. Cl. ..... 36/11.5; 36/7.5; 36/58.5; D2/916; D2/929; D2/943

(58) Field of Classification Search ..... 36/11.5, 36/100, 101, 7.5, 1, 58.5, 76 R, 76 C, 76 HH, 36/72 A, 73, 75 R; D2/916, 929, 933, 939, D2/943

See application file for complete search history.

(56) References Cited

U.S. PATENT DOCUMENTS

| | | | | | |
|---|---|---|---|---|---|
| 3,832,793 | A | * | 9/1974 | Siskin | 36/83 |
| 4,679,334 | A | | 7/1987 | McBride | |
| 4,793,075 | A | | 12/1988 | Thatcher | |
| D429,873 | S | | 8/2000 | Ritter et al. | |
| D458,009 | S | | 6/2002 | Ritter et al. | |
| 6,772,541 | B1 | | 8/2004 | Ritter et al. | |

FOREIGN PATENT DOCUMENTS

| | | |
|---|---|---|
| FR | 893437 | 6/1944 |
| IT | 543576 | 5/1956 |

OTHER PUBLICATIONS

Publication, Gecko the Ultimate Sport Sandals published before Sep. 4, 1997.

* cited by examiner

*Primary Examiner*—Catherine S. Williams

(57) ABSTRACT

A strapping system for footwear comprises a strap (1) that has a first end (3) connected to a first side of a heel portion (12) of footwear, passes over the instep of a foot, through a channel (31) extending through the midfoot of the footwear sole and back over the foot instep to thereby forming an X shape over the wearer's foot. The strap (1) has a second end (11) which may be adjustably connected to the second side of a heel portion (12) of a sole. The channel (31) is resilient and rigid so as to allow the strap freedom of movement during use: thereby achieving a dynamic and self adjusting strap fit. A footwear sole comprises relatively soft forefoot and heel portions with a more rigid shank portion therebetween to provide the sole with stiffness and torsional rigidity.

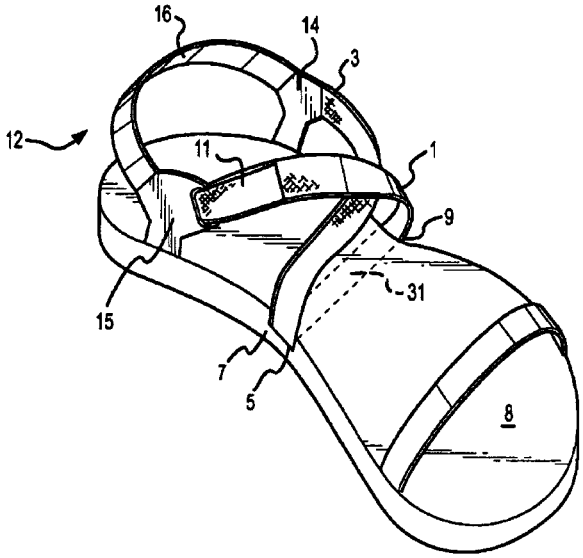

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Col. 7, lines 8–23:

A heel strap [59] *58*, for securing a wearer's heel to the footwear, is preferably attached at a first end 61 to a medial heel post 45, and at a second end to lateral heel post 57. Heel strap [59] *58* second end 63 preferably is adjustable, and thus may extend through heel loop 65, and through a heel fastener 67. Fastener 67 may comprise any of several fasteners that are well known in the art, including, for example, a lever operated buckle as illustrated, mating hooks and loops, mating male/female buckles, buttons, laces, snaps, or the like. Heel strap [59] *58* desirably may be provided with a downwardly extending T-strap member (not shown) that attaches to the center, rear of the sole. If a T-strap is utilized, heel strap fasteners may be provided at one or both of the lateral and medial heel posts so that the wearer may adjust the T-strap as desired. As previously noted, other heel strap configurations may also be used.

AS A RESULT OF REEXAMINATION, IT HAS BEEN DETERMINED THAT:

Claims 1, 2, 5 and 6 are determined to be patentable as amended.

Claims 3 and 4, dependent on an amended claim, are determined to be patentable.

New claims 7–8 are added and determined to be patentable.

1. An X-strap assembly for securing an article of footwear to the instep of a foot, said footwear having a sole and channel through said sole, said X-strap assembly comprising:

a) a strap attached at its respective ends to medial and lateral heel sides of said footwear, said strap having a first portion extending in a forward direction transversely across the instep from a first side of said footwear to a second side, a second portion extending *from said first portion* through said channel, and a third portion extending *from said second portion* in a rearward direction transversely across the instep from said first side to said second side of said footwear, said first and said third portions forming an X-configuration over said instep; wherein said channel is located at the midfoot portion of the sole, [and] wherein said channel passes completely across the sole*, and wherein said channel is the only channel extending generally transversely through said sole*; and b) a fastener attached to said strap.

2. An article of footwear, comprising:

a) a sole, the sole having a midfoot portion and a heel portion;

b) a channel extending transversely across the midfoot portion of said sole;

c) an instep strap connected to said heel portion of said sole, said instep strap having a first portion extending in a forward direction transversely across a wearer's instep from one side of said sole to the other, a second portion extending through said channel and slidable within said channel, and a third portion extending in a rearward direction transversely across the wearer's instep from said one side of said sole to said other side of said sole, the first and third [potions] *portions* of said instep strap forming an X configuration over the wearer's instep, and the second portion being between the first and third portions of said instep strap; [and]

d) an adjustable fastener attached to said instep strap for adjusting said instep strap [.]*; and*

*e) a forefoot strap assembly connected to said sole.*

5. An article of footwear as in claim 4 further comprising a heel portion strap assembly ([59]) *58*[, a forefoot strap assembly (69)] and a lateral strap (59) extending [therebetween] *between said heel portion strap assembly and said forefoot strap assembly.*

6. A footwear product to be worn by a user on the user's foot, comprising:

a) a sole, the sole having a midfoot portion;

b) a transverse passageway extending through said midfoot portion of said sole;

c) a strap system configured to secure the footwear product to the user's foot including: a heel portion, an X-strap assembly coupled to said heel portion, wherein said X-strap assembly includes a continuous strap having a first portion extending transversely across the user's instep from said heel portion on a first side of the footwear to a second side, a second portion extending through said transverse passageway from said second side to said first side*, wherein said second portion is substantially the same length as the length of said transverse passageway,* and a third portion extending transversely across the user's instep from said first side to a heel portion on said second side of said footwear, said first and said third portions of said X-strap assembly forming an X-configuration over the user's instep, *wherein said first portion, said second portion and said third portion are contiguous to each other,* and an adjustable fastener for adjusting the length of said X-strap assembly.

*7. An article of footwear, comprising:*

*a) a sole, the sole having a midfoot portion and a heel portion;*

*b) a channel extending transversely across the midfoot portion of said sole, wherein said channel is the only channel in said sole;*

*c) an instep strap connected to said heel portion of said sole, said instep strap having a first portion extending in a forward direction transversely across a wearer's instep from one side of said sole to the other, a second portion extending through said channel and slidable within said channel, and a third portion extending in a rearward direction transversely across the wearer's instep from said one side of said sole to said other side of said sole, the first and third portions of said instep strap forming an X configuration over the wearer's instep, and the second portion being between the first and third portions of said instep strap; and*

*d) an adjustable fastener attached to said instep strap for adjusting said instep strap.*

*8. A footwear product to be worn by a user on the user's foot, comprising:*

*a sole, the sole having a midfoot portion;*

*a transverse passageway extending through said midfoot portion of said sole, wherein said transverse passageway is the only passageway extending through said sole,*

*a strap system configured to secure the footwear product to the user's foot including: a heel portion,*

*an X-strap assembly coupled to said heel portion, wherein said X-strap assembly includes a continuous strap having a first portion extending transversely across the user's instep from said heel portion on a first side of the footwear to a second side,*

*a second portion extending through said transverse passageway from said second side to said first side,*

*and a third portion extending transversely across the user's instep from said first side to a heel portion on said second side of said footwear, said first and said third portions of said X-strap assembly forming an X-configuration over the user's instep, wherein said first portion, said second portion and said third portion are contiguous to each other, and*

*an adjustable fastener for adjusting the length of said X-strap assembly.*

* * * * *